United States Patent [19]

Hammar

[11] 3,962,886

[45] June 15, 1976

[54] FREEZER ICE TRAY CONSTRUCTION

[75] Inventor: John Rune Hammar, Spanga, Sweden

[73] Assignee: Aktiebolaget Electrolux, Stockholm, Sweden

[22] Filed: Feb. 5, 1975

[21] Appl. No.: 547,266

[30] Foreign Application Priority Data

Feb. 7, 1974 Sweden ..... 7401617

[52] U.S. Cl. ..... 62/340; 249/121

[51] Int. Cl.[2] ..... F25C 1/04

[58] Field of Search ..... 249/66, 127, 120, 121; 62/340; 312/72; 320/245, 246, 247; 220/20–23

[56] References Cited

UNITED STATES PATENTS 2,018,252 10/1935 Cruickshank ..... 249/117

3,374,982 3/1968 Sallade ..... 249/121

*Primary Examiner*—Francis S. Husar
*Assistant Examiner*—R. J. Charvat
*Attorney, Agent, or Firm*—Alfred E. Miller

[57] ABSTRACT

A cover for a freezer ice tray which prevents splashing out of the water in the tray before freezing, and additionally functions to maintain the tray in place in a freezing compartment of a refrigerator housed in a relatively unstable trailer or boat and to improve the heat conducting contact between the ice tray and the evaporator pipe. The cover has a downwardly directed front part along its entire width that substitutes as a door to the freezing compartment.

7 Claims, 10 Drawing Figures

FREEZER ICE TRAY CONSTRUCTION

BACKGROUND OF THE INVENTION

In the so-called compact refrigerators designed for use in boats or house trailers the freezing compartment is small and is generally only slightly larger than the ice tray in order to permit the optimum use of the interior of the refrigerator. It is therefore difficult to remove an ice tray containing ice from the freezer and also to insert the ice tray to be frozen containing water, without spilling some of the water. It can be readily appreciated that boats and house trailers, when moving, are relatively unstable and water which is not entirely frozen into ice cubes may splash out of the tray, and the latter may itself slide out of the freezing compartment upon inclinations of the boat or trailer.

SUMMARY OF THE INVENTION

The invention relates to a freezer ice tray having a cover specifically constructed to retain the water in the ice tray even though the boat or trailer assumes inclinations to level movement and further prevents the ice tray from self-sliding out of the freezing compartment.

It is an object of the present invention to provide a cover for a freezer ice tray having a front flange which functions with a retaining means in the freezing compartment to co-act with said front flange in order to retain the ice tray in position in the compartment. The cover is further provided with a retaining means for engagement with the edge flange of the ice tray.

Another object of the present invention is to provide the cover with a resilient portion that is elevated from the plane of the top of the ice tray.

The invention will now be more fully described with reference to the accompanying drawings, in which.

DESCRIPTION OF THE PREFERRED EMBODIMENT

Figure 1:
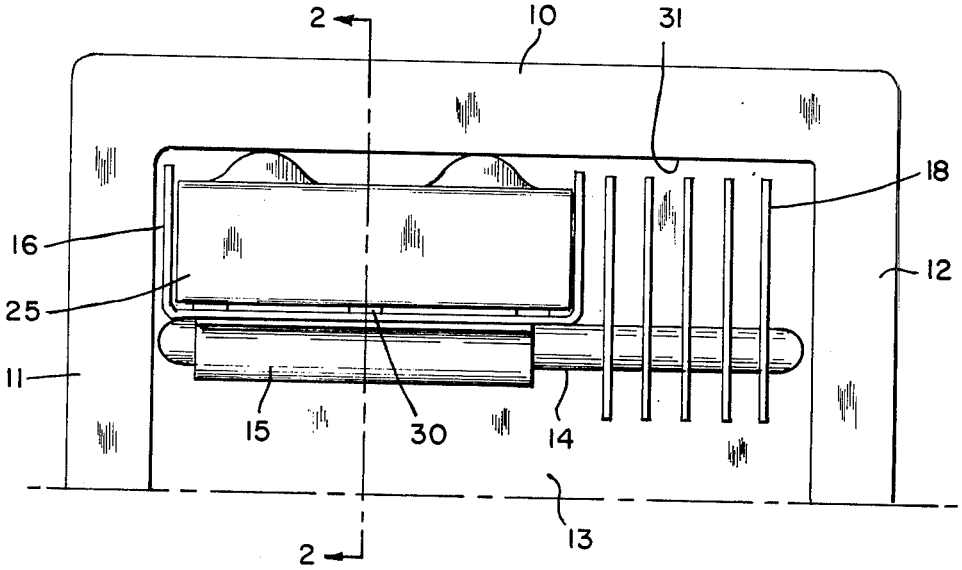
FIG. 1 is a front elevational view of the top portion of a refrigerator with the door removed for purposes of clarity and in which the freezing compartment and ice tray constructed in accordance with the teachings of the present invention is shown.
Figure 2:
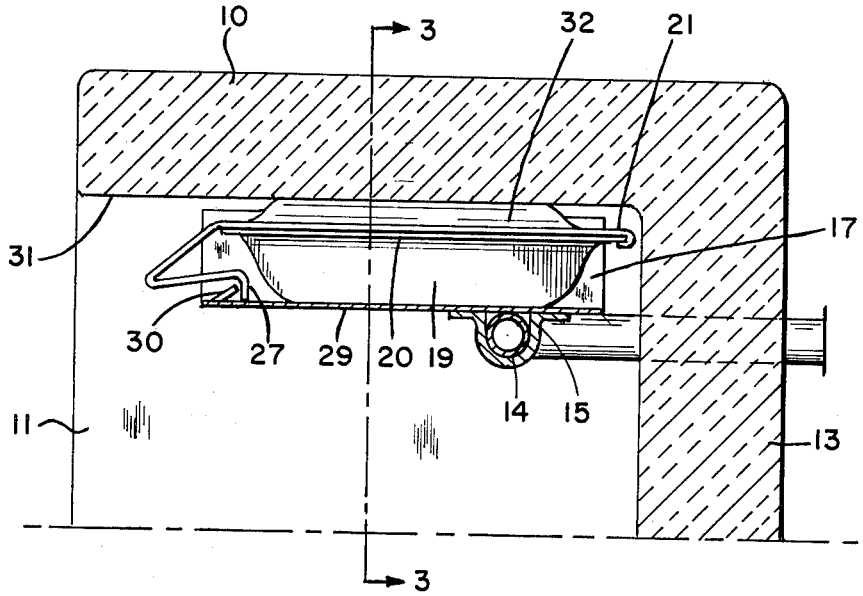
FIG. 2 is a sectional view of the top portion of the refrigerator taken along the lines 2 — 2 of FIG. 1.
Figure 3:
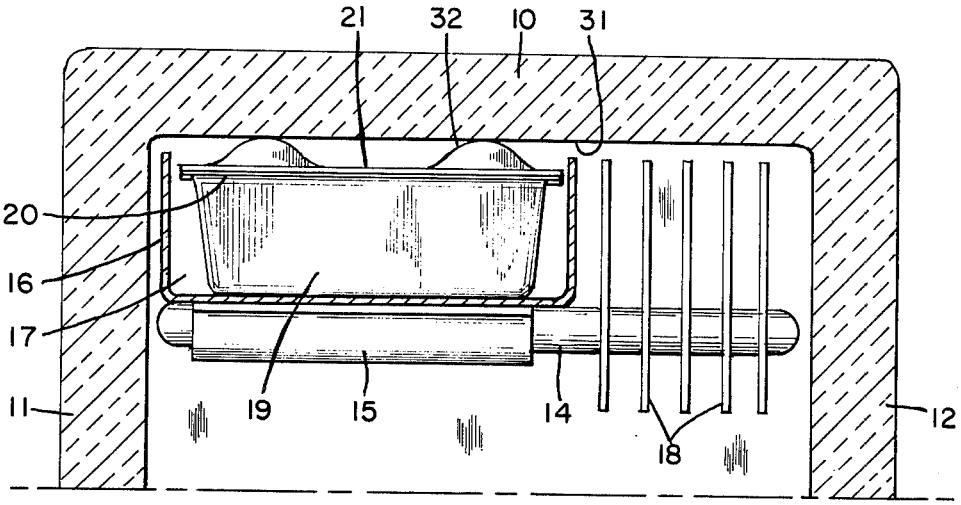
FIG. 3 is another sectional view of the top portion of the refrigerator taken along the lines 3 — 3 of FIG. 2.

The construction and arrangement of the present invention may be utilized in refrigerators employing different type of refrigerating apparatus. The present refrigerator uses an absorption refrigeration apparatus and system (now shown). Referring particularly to FIGS. 1–3, the top portion of a compact refrigerator is shown having a top wall 10, side walls 11 and 12 and rear wall 13. The absorption refrigerator apparatus is provided with an evaporator pipe 14. Attached to the pipe 14 is a clip 15 which is heat-conductively connected to a U-shaped metal plate 16 which together with the top wall 10 of the refrigerator forms a freezing compartment 17. As seen in FIG. 1, part of the evaporator pipe 14 is provided with surface-enlarging fins 18 for cooling the air in the cooling chamber.

Figure 4:
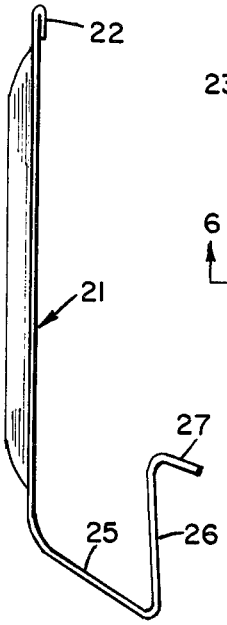
FIG. 4 is a side elevational view of the cover embodied in the present invention.
Figure 6:
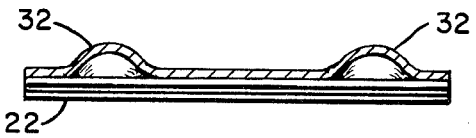
FIG. 6 is a sectional view taken along the lines 6 — 6 of FIG. 5.
Figure 7:
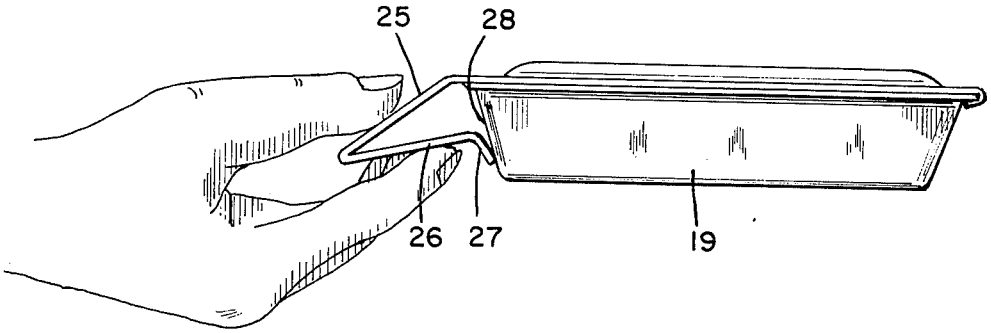
FIG. 7 is a side elevation view of the freezer ice tray.
Figure 8:
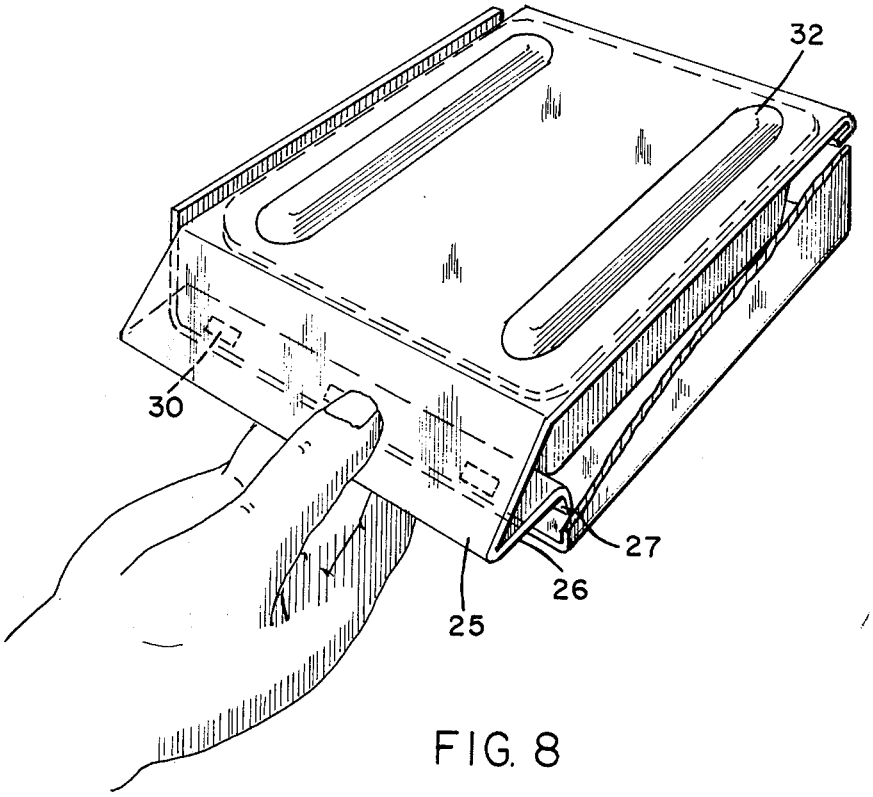
FIG. 8 is a perspective view of the freezer ice tray showing its insertion in the freezing compartment.

The ice tray 19 for the freezing compartment 17 has a peripheral flange 20. A cover 21 of a particular construction is illustrated separately from the ice tray in FIGS. 4–6. This cover is constructed of a resilient material, such as hot-formed polystyrene, and is arranged to be inserted over the ice tray 19 whereby a flange 22 with a return bend engages the rear edge of the peripheral flange 20 of the ice tray, as seen in FIGS. 2 and 7. It will be observed that the peripheral part of the cover 21 that rests on the peripheral flange 20 of the ice tray 19 is flat. It will be noted from FIG. 3 that the two sides 23 and 24 of the cover are substantially parallel and are approximately the same distance from each other as are the underlying edges of the ice tray 19. This construction results in the proper guidance of both the ice tray and its cover between the walls of the freezing compartment 17. A part 25 of the cover 21 projects forwardly and beyond the front of the ice tray 19. This part 25 is bent downwardly from the cover at a forward angle of about 35°. It should be further observed that when the cover 21 is in place on the ice tray 19 it cannot slide rearwardly because the part 25 is provided with a bent part 26 which is integral therewith and of sufficient resiliency to move upwardly against the spring force of the material whereby its free edge 27 abuts the front part 28 of the ice tray 19, as seen in FIG. 7. This construction and arrangement enables one to get a firm grip on the ice tray filled with water for insertion of the tray in the freezing compartment of the refrigerator, as well as for removing the ice tray from the freezing compartment. A firm grip on parts 25 and 26 of the cover causes the latter to be pressed against the ice tray during handling thereby avoiding the spillage of water.

As seen in FIGS. 2, 4, 7 and 8, the free front edge 27 of the cover 21 terminates in the form of a downwardly directed flange. As can be observed in FIGS. 2 and 8, wedge-shaped projections 30 extend upwardly from the bottom 29 of the freezing compartment 17. The resilient edge 27 of the cover 21 is therefore adapted to spring behind the projections 30 so that the ice tray is maintained in place in the freezing compartment and cannot slide out of the compartment even if the refrigerator is caused to tilt due to movement of a trailer or boat.

Figure 5:
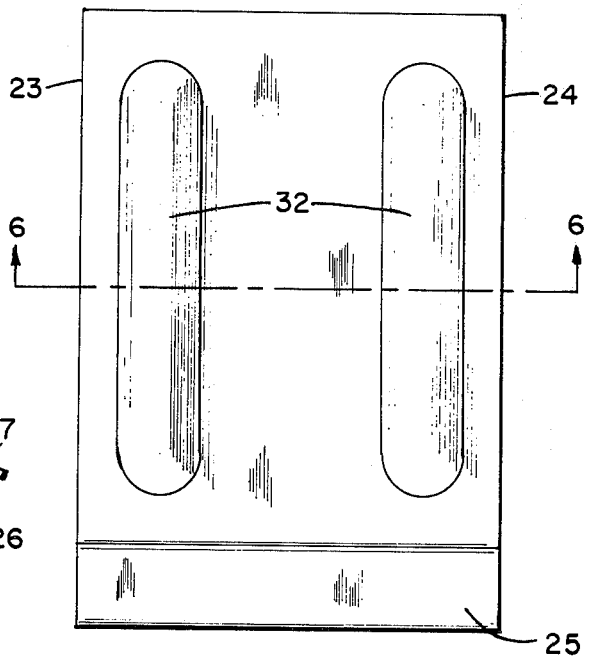
FIG. 5 is a top plan view of the cover shown in FIG. 4.

In order to maintain the cover on the ice tray and to prevent the splashing of water, resilient means in the cover are used which are urged against the top wall 10 of the freezing compartment. These resilient means take the form of spaced ridges 32 in the top of the cover adjacent to the edges 23 and 24 which effect a seal with the peripheral flange 20 of the ice tray 19 (FIG. 5). As seen in FIGS. 1–3 the ridges 32 of the cover 21 engage the inner top wall 31 of the refrigerator with a slight friction, which in turn urges the cover to be seated on the ice tray whereby splashing of the water in the tray is prevented. In addition, the tray itself is urged into firm engagement with the bottom 29 of the freezing compartment 17 so that the heat-conducting contact between the evaporator pipe 14 and the freezing compartment 17 is improved resulting in faster freezing of the ice in the tray 19.

As described above, the cover 21 has a downwardly directed part 25. This part extends along the entire width of the freezing compartment 17 and therefore substitutes as a door for the freezing compartment. This is desirable in order to prevent air in the interior of the refrigerator from circulating in the interior of the freezing compartment and being cooled thereby. If the air flow from the cooling chamber of the refrigerator were permitted to flow into the freezing compartment a considerable additional time would be required in order to freeze the ice in the ice tray.

Figure 10:
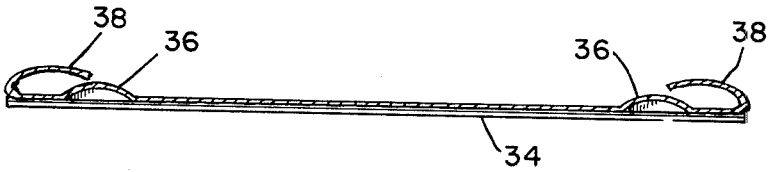
FIG. 9 is a top plan view of an alternate construction of the freezer ice tray cover and FIG. 10 is a sectional view taken along the lines 10 — 10 of FIG. 9.
Figure 9:
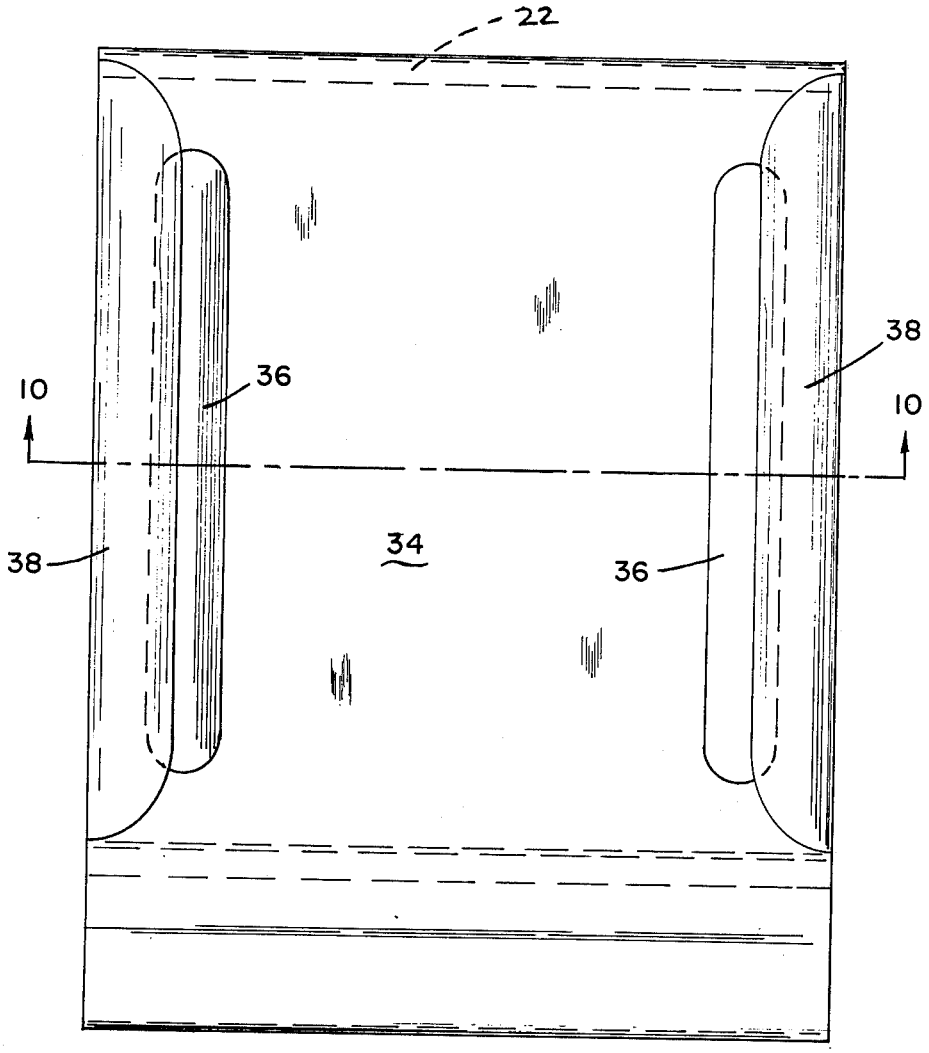

Referring to FIGS. 9 and 10, a cover 34 is shown for the ice tray 19 that is a modification of the cover 21. The cover 34, like the cover 21, is provided with a rear bent flange 22 as well as a front flange. In addition, the cover 34 has ridges 36 that function as stiffening means for the cover 34. As shown particularly in FIG. 10, opposite edges of the cover 34 have resilient flaps 38 extending upwardly and over the respective edges of the cover. The resilient flaps 38 are adapted to yieldably engage the surface 31 of the top wall 10 of the refrigerator to thereby prevent movement of the ice tray upon the tilting movement of either trailer, boat or the like the refrigerator is housed in.

I claim:

1. The combination of a freezing compartment of a refrigerator and an ice tray therein provided with a cover comprising: said ice tray having a peripheral flange and said cover being provided with a bent edge rear flange for engaging a part of the peripheral flange of said ice tray; said freezing compartment having a floor and a ceiling; and resilient means on said cover projecting upwardly therefrom; the tray, cover and resilient means having such a height dimension that the ceiling and floor of said freezing compartment act to maintain the cover and its bearing surfaces pressed to said peripheral flange of the ice tray.

2. The combination of a freezing compartment of a refrigerator and an ice tray therein provided with a cover comprising: said ice tray having a peripheral flange and said cover being provided with a bent edge rear flange for engaging a part of the peripheral flange of said ice tray; a front flange for said cover which projects beyond the front of said tray and is provided with a part that is bent back to form a handgrip for said ice tray and cover; said freezing compartment having a floor and a ceiling; and resilient means on said cover projecting upwardly therefrom; the tray, cover and resilient means having such a height dimension that the ceiling and floor of said freezing compartment act to maintain the cover and its bearing surfaces pressed to said peripheral flange of the ice tray.

3. The combination as claimed in claim 2 wherein said part of the front flange is resilient and is capable of movement upwardly against a spring force so that its free edge abuts the front surface of said tray.

4. The combination as claimed in claim 3 further comprising an upwardly directed projection located on said floor of said freezing compartment, said free edge of the front flange being adapted to snap over said projection upon the insertion of the ice tray into the freezing compartment and maintained therebehind by the spring force of said front flange.

5. The combination as claimed in claim 2 wherein said front flange of the cover substantially covers the front opening in the freezing compartment.

6. The combination as claimed in claim 1 wherein said resilient means are resilient flaps that extend from the opposite edges of said cover and are folded over and spaced from the adjacent top surface of said cover.

7. The combination as claimed in claim 6 further comprising at least one stiffening ridge located on said cover.

* * * * *